US008800481B2

(12) United States Patent
Hoshino

(10) Patent No.: US 8,800,481 B2
(45) Date of Patent: Aug. 12, 2014

(54) ADHESIVE APPLICATION APPARATUS AND CONTROL METHOD OF THE SAME

(75) Inventor: Masaru Hoshino, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 55 days.

(21) Appl. No.: 13/363,545

(22) Filed: Feb. 1, 2012

(65) Prior Publication Data

US 2012/0199066 A1 Aug. 9, 2012

(30) Foreign Application Priority Data

Feb. 7, 2011 (JP) ..... 2011-023652

(51) Int. Cl.
*B05C 11/00* (2006.01)
*B05D 5/10* (2006.01)

(52) U.S. Cl.
USPC ..... 118/663; 427/208

(58) Field of Classification Search
None
See application file for complete search history.

(56) References Cited

U.S. PATENT DOCUMENTS 5,702,559 A * 12/1997 Bright ..... 156/450
2008/0030535 A1* 2/2008 Okawa ..... 347/16

FOREIGN PATENT DOCUMENTS

JP 2009-279538 12/2009

* cited by examiner

*Primary Examiner* — Dah-Wei D Yuan
*Assistant Examiner* — Charles Capozzi
(74) *Attorney, Agent, or Firm* — Workman Nydegger

(57) ABSTRACT

An adhesive application apparatus sets a dot pattern such that an amount of paste applied to an area on the reverse side of an area on which an image is formed and an amount of paste applied to an area on the reverse side of an area on which the image is not formed are different from each other, and controls a paste discharge head so that the dot pattern having been set is formed on an adhesion surface of paper. Through this, the amount of paste applied to paper can be changed between an area where an image is formed and an area where the image is not formed, thereby making it possible to apply the paste to paper more appropriately in accordance with the state of image formation.

7 Claims, 6 Drawing Sheets

ADHESIVE APPLICATION APPARATUS AND CONTROL METHOD OF THE SAME

This application claims the benefit of Japanese Application No. 2011-023652, filed Feb. 7, 2011, all of which is hereby incorporated by reference.

BACKGROUND

1. Technical Field

The present invention relates to an adhesive application apparatus that discharges an adhesive from a discharge head so as to apply the adhesive in dot-pattern form to the reverse of a sheet of paper on which an image is formed using a colorant, and a control method of the adhesive application apparatus.

2. Related Art

As this type of adhesive application apparatus, there has been proposed an apparatus that applies an adhesive to an adhesion surface of a medium by discharging droplets containing the adhesive with an ink jet technique (for example, see JP-A-2009-279538). In the apparatus, the amount of adhesive application to a contour portion of the adhesion surface is less than that to the central portion thereof per unit area so as to prevent the adhesive from running off from the contour potion when adhesion operation is performed.

However, in the above apparatus, since the amount of adhesive to the contour portion is uniformly applied less than that to the central portion regardless of the state of a medium, there is a risk that adhesion operation may not be appropriately performed depending on the state of the medium. In particular, in the case where paper on which an image is formed using a colorant is used as a medium, not only the adhesive but also the colorant penetrates into the paper. Therefore, the degree of penetration of the adhesive is caused to change depending on the state of image formation, which may affect the adhesion effect.

SUMMARY

An advantage of some aspects of the invention is to provide an adhesive application apparatus and a control method thereof, and the principal object of the apparatus and the method is to apply an adhesive to paper more appropriately in accordance with the state of image formation.

In order to accomplish the above object, the adhesive application apparatus and the control method thereof according to the invention have adopted the following configuration.

The adhesive application apparatus of the invention is an adhesive application apparatus that discharges an adhesive from a discharge head so as to apply the adhesive in dot-pattern form to the reverse of a sheet of paper on which an image is formed using a colorant, and includes: a dot pattern setting unit that sets a dot pattern such that an amount of the adhesive discharged to an area on the reverse side of an area on which the image is formed and an amount of the adhesive discharged to an area on the reverse side of an area on which the image is not formed are different from each other; and a control unit that controls the discharge head so that the dot pattern having been set is formed on the reverse of the paper.

The adhesive application apparatus of the invention sets a dot pattern such that an amount of adhesive discharged to an area on the reverse side of an area on which an image is formed and an amount of adhesive discharged to an area on the reverse side of an area on which the image is not formed are different from each other, and controls the discharge head so that the dot pattern having been set is formed on the reverse of the paper. With this, the amount of adhesive applied to the paper can be changed between an area where the image is formed and an area where the image is not formed, thereby making it possible to apply the adhesive to the paper more appropriately in accordance with the state of image formation.

In the adhesive application apparatus of the invention, it is preferable for the dot pattern setting unit to be a unit that sets a dot pattern such that the adhesive is applied only to an area on the reverse side of an area on which the image is formed in a case of using a predetermined type of paper, whereas in a case of using a different type of paper from the predetermined one, the adhesive is applied only to an area on the reverse side of an area on which the image is not formed. It is to be noted that an area on which an image is formed may deform to be in a crinkled state due to penetration of a colorant in some case. When the adhesive is applied to such a deformed portion, a tension force accompanying the hardening of adhesive is exerted on the deformed portion so as to modify the deformation, or the deformation is accelerated because of further penetration of the adhesive applied, depending on a type of paper in some case. Therefore, it is possible to suppress deformation of paper by exerting the tension force accompanying the hardening of adhesive on the deformed portion in a crinkled state, suppress deformation of paper from being accelerated due to further penetration of the adhesive into the deformed portion in a crinkled state, and so on, in accordance with a type of paper.

Further, in the adhesive application apparatus of the invention, it is preferable for the dot pattern setting unit to be a unit that defines an area where the amount of consumption of the colorant is equal to or greater than a predetermined value to be an area on which the image is formed, defines an area where the amount of consumption of the colorant is less than the predetermine value to be an area on which the image is not formed, and changes the amount of discharge of the adhesive in accordance with the amount of consumption of the colorant so as to set the dot pattern mentioned above. With this, it is possible to set a dot pattern by a simple processing based on the amount of consumption of the colorant. In the adhesive application apparatus according to this aspect of the invention, it is preferable for the dot pattern setting unit to be a unit that sets the dot pattern such that the amount of discharge of the adhesive is likely to be larger as the amount of consumption of the colorant is larger. In contrast, in the adhesive application apparatus according to this aspect of the invention, it is preferable for the dot pattern setting unit to be a unit that sets the dot pattern such that the amount of discharge of the adhesive is likely to be smaller as the amount of consumption of the colorant is larger.

Furthermore, in the adhesive application apparatus of the invention, it is preferable for the dot pattern setting unit to be a unit that sets a dot pattern such that the adhesive is applied only to an area on the reverse side of an area on which the image is formed in a case of using a predetermined type of paper. Through this, it is possible to suppress deformation of paper by exerting the tension force accompanying the hardening of adhesive on the deformed portion in a crinkled state.

In addition, in the adhesive application apparatus of the invention, it is preferable for the dot pattern setting unit to be a unit that sets a dot pattern such that the adhesive is applied only to an area on the reverse side of an area on which the image is not formed in a case of using a predetermined type of paper. Through this, it is possible to suppress deformation of paper from being accelerated due to further penetration of the adhesive into the deformed portion in a crinkled state.

A control method of an adhesive application apparatus according to the invention is a control method of an adhesive application apparatus that discharges an adhesive from a discharge head so as to apply the adhesive in dot-pattern form to the reverse of a sheet of paper on which an image is formed using a colorant, and includes: a step of setting a dot pattern such that an amount of the adhesive discharged to an area on the reverse side of an area on which the image is formed and an amount of the adhesive discharged to an area on the reverse side of an areas on which the image is not formed are different from each other; and a step of controlling the discharge head so that the dot pattern having been set is formed on the reverse of the paper.

The control method of the adhesive application apparatus of the invention sets a dot pattern such that the amount of adhesive discharged to an area on the reverse side of an area on which an image is formed and the amount of adhesive discharged to an area on the reverse side of an area on which the image is not formed are different from each other, and controls the discharge head so that the dot pattern having been set is formed on the reverse of the paper. Through this, the amount of adhesive applied to the paper can be changed between an area where the image is formed and an area where the image is not formed, thereby making it possible to apply the adhesive to the paper more appropriately in accordance with the state of image formation. Note that, in the control method of the adhesive application apparatus, various aspects of the adhesive application apparatus described above may be employed, and steps that implement the functions of the adhesive application apparatus described above may be added.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
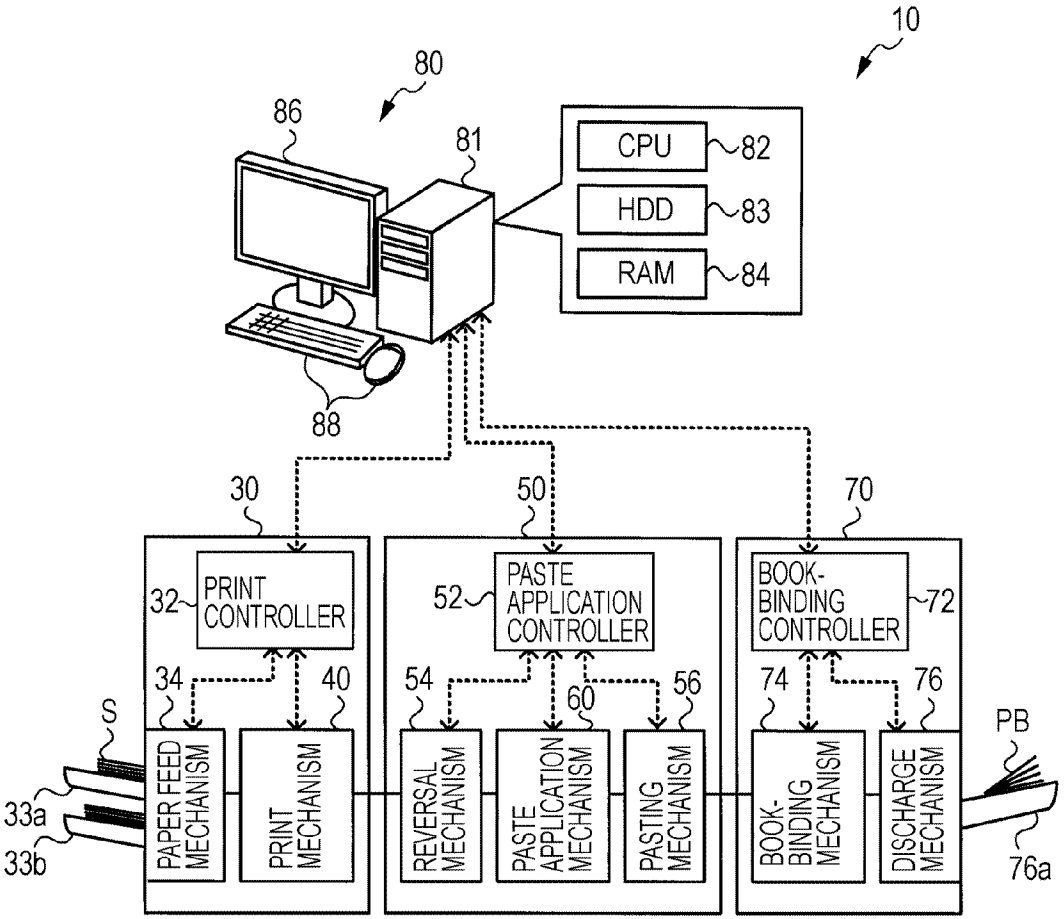
FIG. 1 is a block diagram illustrating an example of a schematic configuration of a book-binding system.
Figure 2:
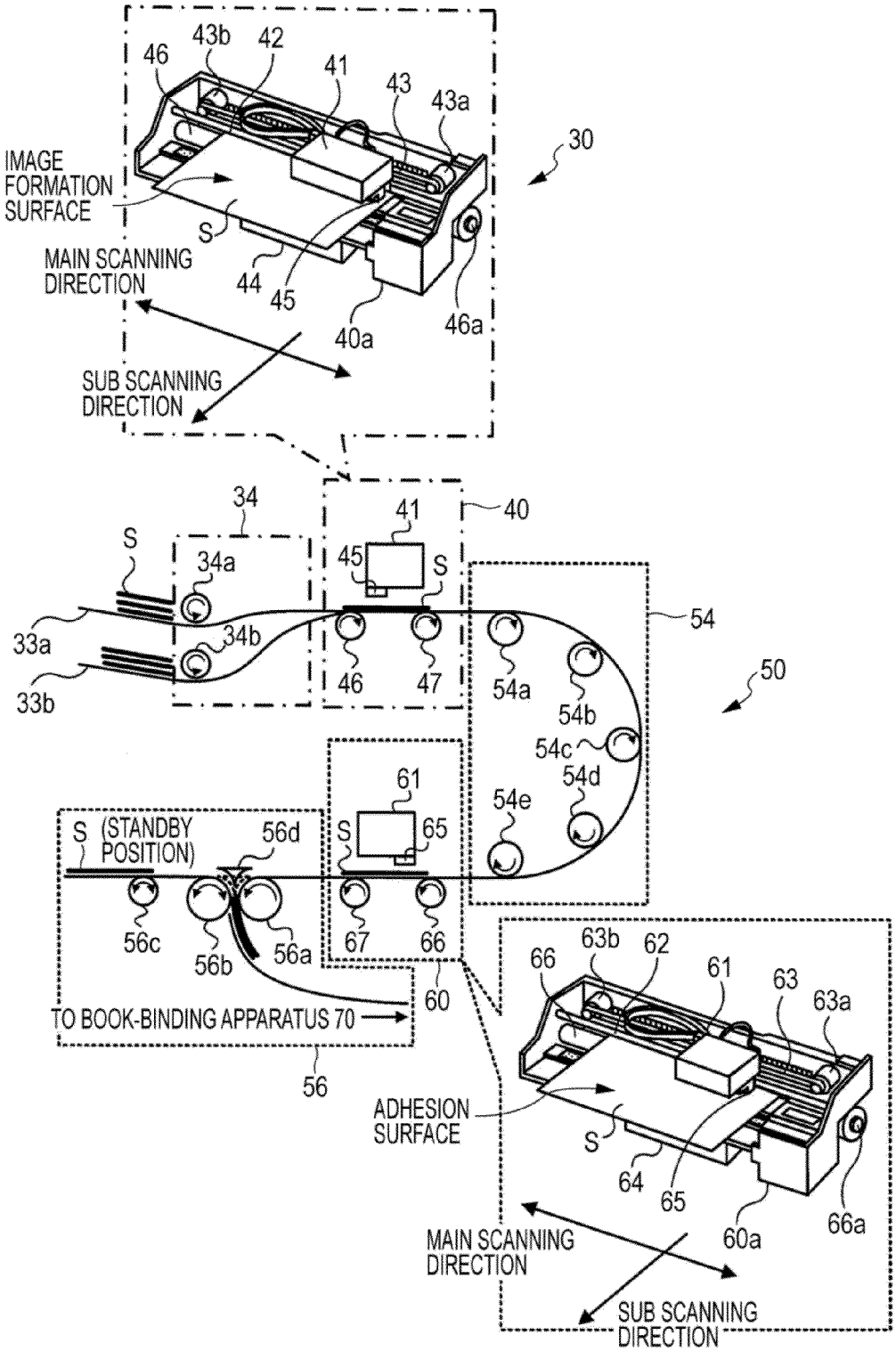
FIG. 2 is a block diagram illustrating an example of a schematic configuration of a print apparatus and a paste application apparatus.
Figure 3:
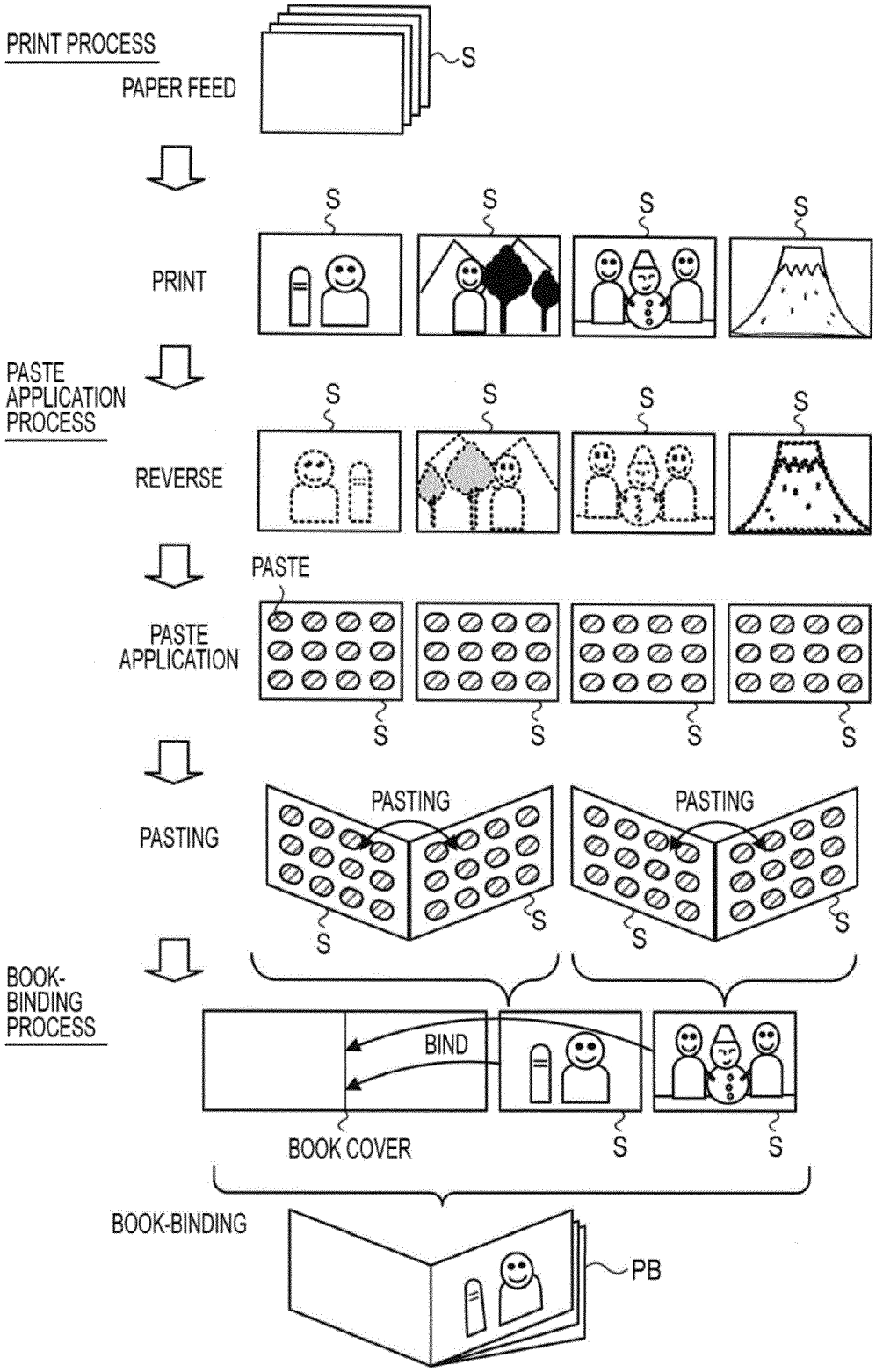
FIG. 3 is a descriptive diagram illustrating an example of each process in the book-binding system.

Hereinafter, embodiments of the invention will be described with reference to the drawings. FIG. 1 is a block diagram illustrating an example of a schematic configuration of a book-binding system 10 including a paste application apparatus 50 according to an embodiment of the invention; FIG. 2 is a block diagram illustrating a schematic configuration of a print apparatus 30 and the paste application apparatus 50 in the book-binding system 10; and FIG. 3 is a descriptive diagram illustrating an example of each process in the book-binding system 10. The book-binding system 10 according to this embodiment includes, as shown in FIGS. 1 and 2, the print apparatus 30 that performs a print process to print an image such as a photograph and the like (see FIG. 3 for each process) on the surface of a fed paper S (image formation surface), the paste application apparatus 50 that performs a paste application process which reverses the paper S having been printed on and applies a paste to the reverse of the paper S (adhesion surface) so as to paste the adhesion surfaces to each other, a book-binding apparatus 70 that performs a book-binding process to bind into a photo book PB by combining the paper S whose adhesion surfaces are pasted to each other and a book cover, and a computer 80 that controls the whole system. In this embodiment, the adhesion surface of an odd-numbered sheet of paper S and the adhesion surface of an even-numbered sheet of paper S are pasted to each other. Further, in FIG. 2, elements constituting the print apparatus 30 are surrounded with a dashed-dotted line, and elements constituting the paste application apparatus 50 are surrounded with a dotted line.

As shown in FIG. 1, the print apparatus 30 includes: a print controller 32 that has a CPU, a ROM, a RAM and so on (not shown in the drawing) and controls the whole apparatus; a paper feed mechanism 34 that has two paper feed trays 33*a*, 33*b* in which two types of paper S can be set, paper feed rollers 34*a*, 34*b* provided in the respective paper feed trays (see FIG. 2) and the like, and feeds the paper S; and a print mechanism 40 that discharges ink with an ink jet technique onto the paper S fed by the paper feed mechanism 34. It should be noted that the two types of paper S are different from each other in degrees of penetration of ink and paste, paper thickness, paper size and the like.

The print controller 32, being communicably connected with the computer 80, receives a print command from the computer 80, transmits the state of image formation to the computer 80, and so on. The print controller 32 controls the paper feed mechanism 34, based on specification of a type of paper S included in the received print command, to feed paper S from a tray in which the specified type of paper S is set out of the paper feed trays 33*a*, 33*b*, controls the print mechanism 40 to perform print processing on paper S based on print data included in the print command, and so on.

As shown in FIG. 2, the print mechanism 40 includes: a carriage motor 43*a* disposed to the right of a mechanical frame 40*a* in the drawing; a slave roller 43*b* disposed to the left of the mechanical frame 40*a* in the drawing; a carriage belt 43 stretched upon between the carriage motor 43*a* and the slave roller 43*b* in loop form in the lateral direction (main scanning direction); a carriage 41 that moves back and forth in the left and right directions along a guide 42 driven by the carriage belt 43 with rotational drive of the carriage motor 43*a*; ink cartridges 44 that supply inks of cyan (C), magenta (M), yellow (Y), and black (K) colors to the carriage 41 through tubes (not shown); a print head 45 that pressurizes ink supplied from each of the ink cartridges 44 so as to discharge the ink onto paper S through a plurality of nozzles (not shown); a transport roller 46 that transports paper S in the sub scanning direction which is orthogonal to the main scanning direction; a drive motor 46*a* that drives the transport roller 46; and a discharge roller 47, driven by a motor (not shown), that discharges paper S having been printed on to the side of the paste application apparatus 50. Note that a plurality of nozzles (not shown) are formed in the print head 45 so that the density of dots formed by discharged ink is, for example, 720 dpi, 1440 dpi or the like, and the print head 45 adopts a discharge technique in which a piezoelectric element is deformed by applying a voltage thereto and the deformation of the piezoelectric element pressurizes the ink so as to discharge it through each nozzle. However, the print head 45 may adopt another discharge technique in which a voltage is applied to a heating element (for example, heater) to heat ink so as to generate air bubbles that will pressurize the ink.

As shown in FIG. 1, the paste application apparatus 50 includes: a paste application controller 52 that has a CPU, a ROM, a RAM and the like (these are not shown) and controls the whole apparatus; a reversal mechanism 54 that has a plurality of reversal rollers 54*a* through 54*e* (see FIG. 2), a guide roller (not shown) and the like, and turns upside down paper S having been printed on by the print apparatus 30; a paste application mechanism 60 that discharges a liquid-form paste with a technique similar to the ink jet technique and applies the paste to the paper S having been turned over by the reversal mechanism 54; and a pasting mechanism 56 that pastes the adhesion surfaces of paper S to each other to which the paste has been applied by the paste application mechanism 60.

The paste application controller 52, being communicably connected with the computer 80, receives a paste application command from the computer 80, transmits the state of paste application to the computer 80 and so on. Note that specification of a type of paper S, print data and the like are also included in the paste application command as in the print command. The paste application controller 52, upon receiving a paste application command, controls the reversal mechanism 54 to turn upside down the paper S having been printed on and supply the paper S to the paste application mechanism 60 one after another, controls the paste application mechanism 60 to apply a paste to adhesion surfaces of paper S having been turned over, controls the pasting mechanism 56 to paste the adhesion surfaces of paper S to each other to which the paste has been applied, and so on.

The paste application mechanism 60 has the same configuration as the print mechanism 40 except that the paste application mechanism 60 includes liquid-form paste cartridges 64 and a paste discharge head 65 in place of the ink cartridges 44 and the print head 45 in the print mechanism 40, respectively. Accordingly, each of the elements configuring the paste application mechanism 60 is given a reference numeral which is obtained by adding the numerical value 20 to each of the reference numerals of the elements configuring the print mechanism 40, and description thereof will be omitted. Note that a plurality of nozzles (not shown) are provided in the paste discharge head 65 so that the density of dots formed by discharged paste is, for example, 20 dpi, 60 dpi, 90 dpi or the like, and the paste discharge head 65 adopts a discharge technique in which a piezoelectric element is deformed by applying a voltage thereto and the deformation of the piezoelectric element pressurizes the liquid-form paste so as to discharge it through each nozzle in the same manner as the print head 45.

The pasting mechanism 56 includes a pair of pasting rollers 56*a*, 56*b*, a transport roller 56*c* that transports paper S to a predetermined standby position, and a guide 56*d* that moves up and down in the vertical direction between the pasting rollers 56*a*, 56*b* so as to guide paper S. The pasting rollers 56*a*, 56*b* transport the paper S which has been applied a paste by the paste application mechanism 60 and discharged by a discharge roller 67, paste adhesion surfaces of paper S to each other while being pressed by a pressing mechanism (not shown), and so on. In the pasting mechanism 56, firstly, when paste application to an odd-numbered sheet of paper S is finished, the pasting rollers 56*a*, 56*b* and the transport roller 56*c* are each normally rotated in the left direction in the drawing with the guide 56*d* being lowered (indicated by a dotted line in the drawing) so as to transport the paper S passing through the upper surface of the guide 56*d* to the predetermined standby position where the odd-numbered sheet of paper S is made to stand by. Subsequently, when paste application to a following even-numbered sheet of paper S is finished, the transport roller 56*c* is reversely rotated in the right direction in the drawing with the guide 56*d* being raised (indicated by a solid line in the drawing) so as to transport the odd-numbered sheet of paper S from the standby position and make a gripper of the pasting roller 56*b* (not shown) grip an end portion of the odd-numbered sheet of paper S (end portion at the right side in the drawing), and a gripper of the pasting roller 56*a* (not shown) is made to grip an end portion of the even-numbered sheet of paper S (end portion at the left side in the drawing). Next, with the pair of pasting rollers 56*a*, 56*b* being pressed to each other by the pressing mechanism (not shown), the pasting roller 56*a* is normally rotated and the pasting roller 56*b* is reversely rotated so as to paste the adhesion surfaces of paper S to each other while drawing in the odd-numbered sheet of paper S and even-numbered sheet of paper S downward in the drawing. When the sheets of paper S have been drawn in to some degree, the gripping of the paper S performed by the grippers of the pasting rollers 56*a*, 56*b* is released, and thereafter the pasting of the paper S is continued while drawing in the sheets of paper S downward with rotation of the pasting rollers 56*a*, 56*b*. Then the sheets of paper S whose adhesion surfaces are pasted to each other are sent to the side of the book-binding apparatus 70.

As shown in FIG. 1, the book-binding apparatus 70 includes a book-binding controller 72 that has a CPU, a ROM, a RAM and the like (these are not shown) and controls the whole apparatus, a book-binding mechanism 74 that has a book cover tray (not shown) and binds a photo book PB by combining the paper S discharged from the paste application apparatus 50 and a book cover supplied from the book cover tray, and a discharge mechanism 76 that has a discharge roller and the like (not shown) and discharges the photo book PB having been bound by the book-binding mechanism 74 to a discharge tray 76*a*.

The book-binding controller 72, being communicably connected with the computer 80, receives a book-binding command from the computer 80, transmits the state of book-binding to the computer 80, and so on. The book-binding controller 72, upon receiving a book-binding command, controls the book-binding mechanism 74 and the discharge mechanism 76, based on the received book-binding command, to bind the paper S transported from the paste application apparatus 50 into the photo book PB and discharge it. As shown in FIG. 3, in order to bind a book, the book-binding process combines the paper S discharged from the paste application apparatus 50 and the book cover, and binds an end portion of the paper S (left end portion in the drawing) to the central portion of the inside face of the book cover with, for example, a string, a wire, a paste or the like. As the book-binding mechanism 74, the discharge mechanism 76 and the like do not constitute the core of the invention, detailed descriptions of these mechanisms are omitted.

The computer 80 is configured as a general-purpose computer that includes: a computer main body 81 equipped with a CPU 82 which performs various kinds of processing, a hard disk drive (HDD) 83 which stores various applications, data and the like, a RAM 84 which temporarily stores data, and so on; a display 86 which displays various kinds of information; and an input device 88, such as a key board, a mouse and the like, with which a user inputs various commands. The computer 80 accepts selection of a print-target image, setting of a type of paper S and the like via operation of the input device 88 by a user on a book-binding setting screen (not shown) which is displayed on the display 86. Further, the computer 80 creates a print command for the print apparatus 30, a paste application command for the paste application apparatus 50, a book-binding command for the book-binding apparatus 70 and the like, based on the contents having been accepted. Then, the computer 80 outputs the print command to the print apparatus 30, inputs the state of printing from the print apparatus 30*a*, outputs the paste application command to the paste application apparatus 50 based on the inputted state of printing, inputs the state of paste application from the paste application apparatus 50, outputs the book-binding command to the book-binding apparatus 70 based on the inputted state of paste application, inputs the state of book-binding from the book-binding apparatus 70, and so on. Here, specification of a type of paper S set by a user, print data generated from image data of the selected image and the like are included in the print command, paste application command, and the like. The generation of print data is performed as follows. That is, for example, image data of RGB colors in which pixels are arranged in matrix form is resolution-converted to coordinate with resolution (dot density) of the print head 45. Here, each of RGB colors is represented with 8 bits. The resolution-converted image data is color-converted to data of CMYK colors each of which is represented with 8 bits. Then, the color-converted data is converted to data of CMYK colors each of which is represented with 2 bits so as to form dots. Note that the data of CMYK colors each of which is represented with 2 bits is formed as data in which each of CMYK colors has a total of four levels, i.e., a large dot, a medium dot, a small dot and no dot, so as to correspond to the amount of discharge of each color ink at each pixel.

Figure 4:
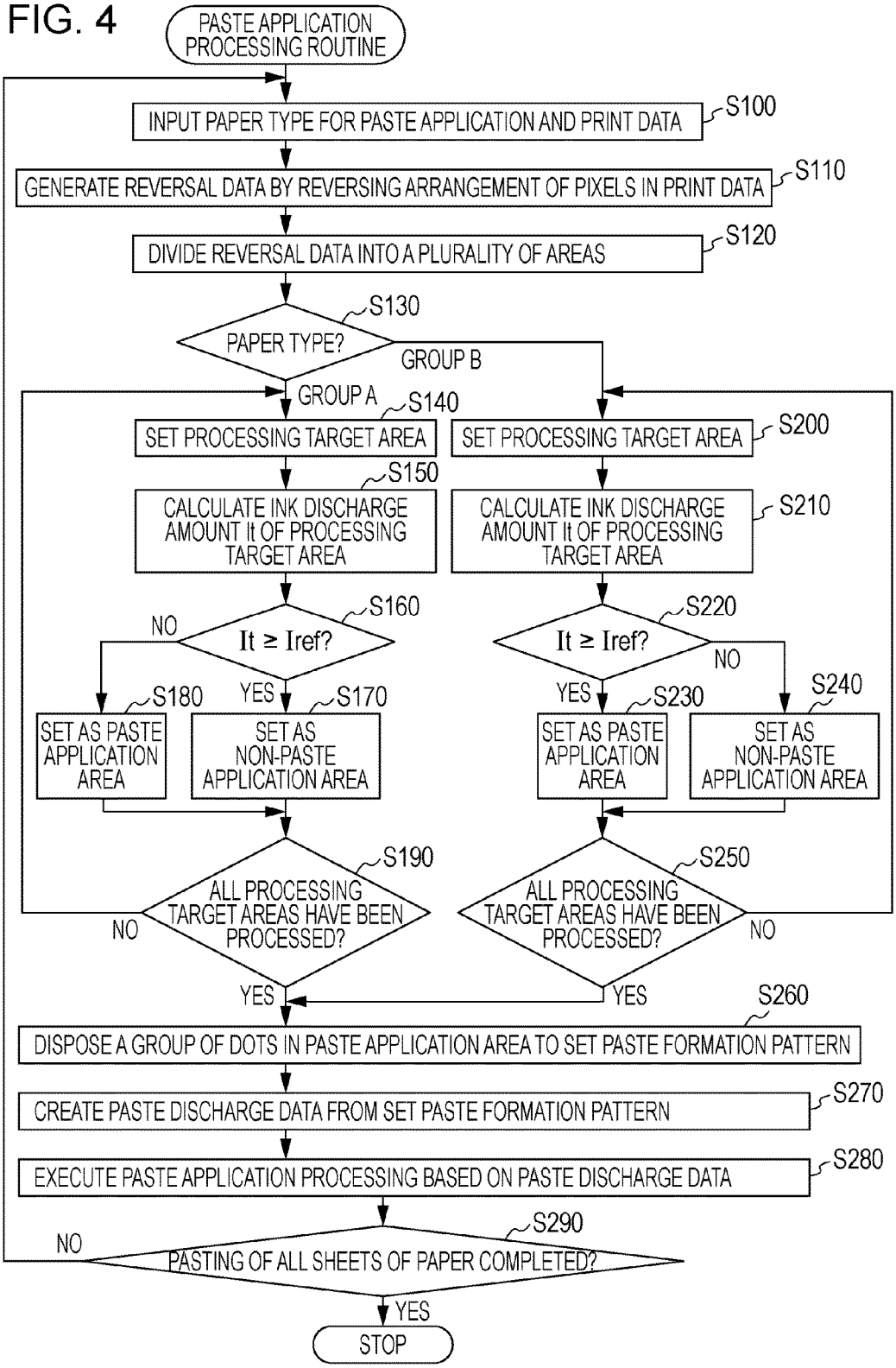
FIG. 4 is a flowchart illustrating an example of a paste application processing routine.
Figure 5A:
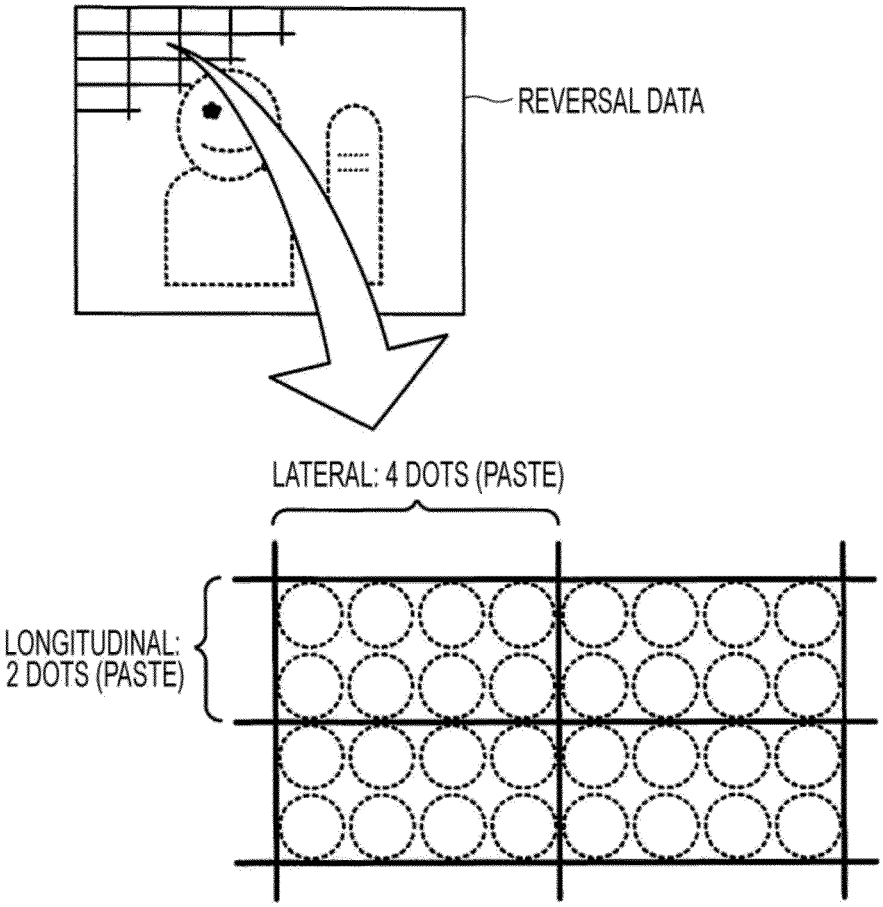
FIGS. 5A and 5B are descriptive diagrams illustrating an example of a process that divides reversal data.
Figure 5B:
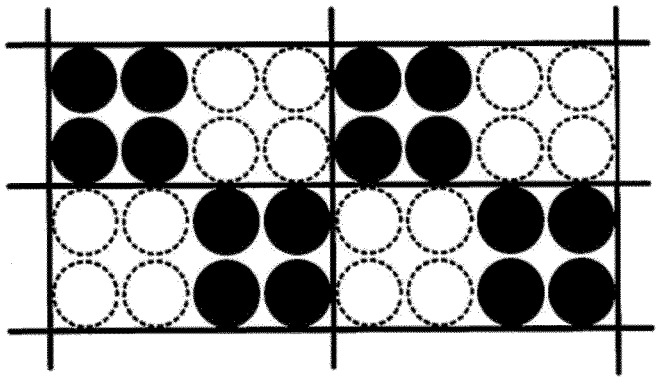

Next, operations of the book-binding system 10 configured as described above according to this embodiment will be described below, in particular, operations in which a paste is applied to paper S in the paste application apparatus 50 will be described. FIG. 4 is a flow chart illustrating an example of a paste application processing routine executed by the paste application controller 52. This routine is executed when a paste application command is received from the computer 80. When this routine is executed, the paste application controller 52, first, inputs a paper type of paper S for paste application that is included in the received paste application command, and print data of an image formed on the paper S for paste application (step S100). Subsequently, the taste application controller 52 generates reversal data by reversing the print data (step S110), and divides the generated reversal data into a plurality of areas (step S120). The reversal data is generated as follows. That is, each pixel data of CMYK colors with 2 bits each in the print data is acquired from the pixel on the upper-right corner first as a starting point, then each pixel data is sequentially acquired in a direction from right to left and in a direction from top to bottom with respect to the starting point. Further, the pixel data on the upper-right corner acquired as the starting point is arranged on the upper-left corner, then with respect to this arranged pixel data, each pixel data is sequentially arranged in a direction from left to right and in a direction from top to bottom. Accordingly, the reversal data is generated as data in which arrangement of pixels of the print data is laterally reversed. Furthermore, the division of the reversal data is performed so that the data is divided into areas which are respectively formed with a plurality of longitudinally and laterally arranged dots based on a paste dot size formed by the discharged paste. FIGS. 5A and 5B are descriptive diagrams illustrating an example of a process that divides reversal data. A white circle in FIG. 5A (illustrated with a dotted line) indicates a single paste dot size; based on this paste dot as a reference, reversal data is divided into areas each of which is formed with 2 longitudinally arranged dots (paste dots)×4 laterally arranged dots (paste dots). Note that, as described above, the print head 45 and the paste discharge head 65 are respectively provided with a plurality of nozzles each having different dot densities, and arrangement of pixels of the print data is coordinated with a dot density of the print head 45. Therefore, for example, in the case where pixels of the print data are arranged in a density of 720 dpi longitudinal×720 dpi lateral, and paste dots are formed in a density of 90 dpi longitudinal×90 dpi lateral, 16 pixels longitudinal×32 pixels lateral are included in an area of 2 dots longitudinal (paste dots)×4 dots lateral (paste dots). FIG. 5B illustrates a state in which the paste is applied to areas that are set as paste application areas (paste dots are formed) by processing which will be described later. A black circle in FIG. 5B indicates a paste dot, and a group of 4 dots formed in an island-like shape is arranged in a hound's tooth pattern in this embodiment.

Having divided the reversal data into the plurality of areas in such manner described above, it is judged whether the inputted paper type is a group A or group B type (step S130). In this embodiment, a plurality of paper types are available and degrees of penetration of ink and paste, thickness of paper, and the like differ depending on the paper type as described above. If the degrees of penetration, the thickness of paper and the like differ as mentioned above, a condition of paper S can largely differ between a case where a paste is applied to an area of the paper S on which an image has been printed and a case where the paste is applied to an area without an image printed. For example, an area on which an image is printed deforms to be in a crinkled state due to penetration of ink in some case; when a paste is applied to such deformed potion, the deformation can be modified because the tension force accompanying the hardening of paste is exerted thereon, or the deformation can be accelerated due to further penetration of the paste having been applied, depending on a degree of paste penetration, paper thickness and the like. Furthermore, as paper S is thinner in paper thickness, deformation in a crinkled state can be accelerated due to a limited amount of absorption of ink, paste or the like; in contrast, as paper S is thinner in paper thickness, deformation in a crinkled state can be modified because the paper S is likely to be effected by the tension force accompanying the hardening of paste. Glossy photo paper, matte photo paper, matte paper, plain paper and the like have been prepared so as to determine such difference in behavior between the paper types by experiments and the like in advance. Thus, a paper type that is capable of suppressing paper S from deformation when a paste is applied to an area without a printed image is classified into a group A, and a paper type that is capable of suppressing paper S from deformation when the paste is applied to an area with a printed image is classified into a group B; then the classification result defined as a paper type classification table (not shown) is stored in advance in the ROM of the paste application controller 52.

In the case where a paper type belongs to the group A, a processing target area is set among the plurality of divided areas (step S140) and an ink discharge amount It of the processing target area is calculated (step S150). Here, each processing target area is sequentially set, starting from the area on the upper-left corner of the reversal data as a starting point, and therefrom proceeding in a direction from left to right and in a direction from top to bottom. Further, the numbers of dots of each size are counted from the data of large dots, medium dots, small dots, and no dots representing data of pixels, i.e., CMYK colors included in the processing target area. Then, the ink discharge amount It of the processing target area is calculated by accumulating a product of each counted dot number and the amount of ink of each dot size. Next, it is judged whether or not the calculated ink discharge amount It is equal to or greater than a predetermined threshold value Iref (step S160). If the ink discharge amount It is equal to or greater than the predetermined threshold value Iref, the processing target area is set to be a non-paste application area (step S170); if the ink discharge amount It is less than the predetermined threshold value Iref, the processing target area is set to be a paste application area (step S180). The predetermined threshold value Iref is set as a threshold value for judging whether or not the processing target area is an area for printing an image, and the value Iref is determined by: preparing some sample images to obtain ink discharge amounts needed to print the sample images per unit area, then determining the value Iref from the ink discharge amounts obtained, for example. Then, it is judged whether or not all the processing target areas have been processed (step S190). If all the areas have not been processed yet, the routine goes back to step S140 to repeat the processings; if all the areas have been processed, the routine proceeds to a subsequent processing.

Meanwhile, if it is judged at step S130 that the paper type belongs to the group B, a processing target area is set among the plurality of divided areas (step S200) and the ink discharge amount It of the processing target area is calculated (step S210). Note that the processings of steps S200 and S210 are performed in the same manner as those of the aforementioned steps S140 and S150. Next, it is judged whether or not the calculated ink discharge amount It is equal to or greater than the predetermined threshold value Iref (step S220). If the ink discharge amount It is equal to or greater than the predetermined threshold value Iref, the processing target area is set to be a paste application area (step S230); if the ink discharge amount It is less than the predetermined threshold value Iref, the processing target area is set to be a non-paste application area (step S240). As described thus far, in the case where a paper type belongs to the group A, an area whose ink discharge amount It is equal to or greater than the predetermined threshold value Iref is set to be a non-paste application area, and an area whose ink discharge amount It is less than the predetermined threshold value Iref is set to be a paste application area; whereas in the case where the paper type belongs to the group B, area-setting is performed in the opposite manner to the case of the group A, that is, an area whose ink discharge amount It is equal to or greater than the predetermined threshold value Iref is set to be a paste application area, and an area whose ink discharge amount It is less than the predetermined threshold value Iref is set to be a non-paste application area. Thereafter, it is judged whether or not all the processing target areas have been processed (step S250). If not all of the areas have been processed yet, the routine goes back to step S200 to repeat the processings; if all the areas have been processed, the routine proceeds to a subsequent processing.

Figure 6:
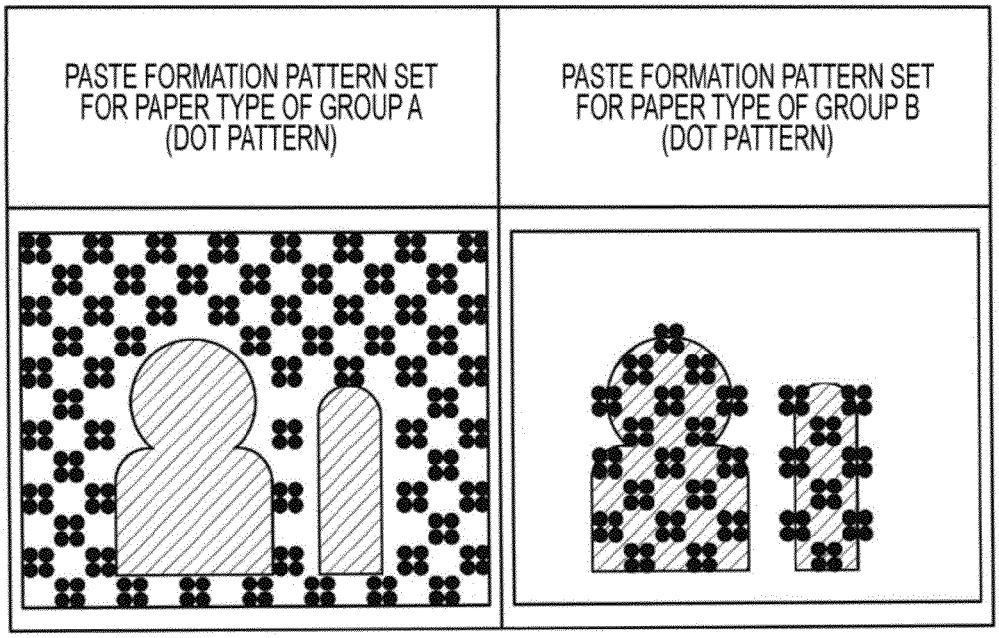
FIG. 6 is a descriptive diagram illustrating an example of paste formation patterns.

After the plurality of areas are set to either a paste application area or a non-paste application area in the manner describe above, a group of dots is disposed in each paste application area to set a paste formation pattern (step S260). FIG. 6 is a descriptive diagram illustrating an example of paste formation patterns. As describe above, in the case of group A, an area whose ink discharge amount It is less than the predetermined threshold value Iref is set to be a paste application area, whereas in the case of group B, an area whose ink discharge amount It is equal to or greater than the predetermine threshold value Iref is set to be a paste application area. Accordingly, as shown in the drawing, a paste formation pattern of the group A and a paste formation pattern of the group B are inverted patterns of each other. Then, nozzle discharge data serving as discharge on-off data for the respective nozzles of the paste discharge head 65 is created from the paste formation pattern set as described above (step S270). Subsequently, a paste application processing is performed on the paper S based on the created paste discharge data (step S280). This paste application processing is performed by repeating the following processings: a carriage motor 63*a* is controlled to make a carriage 61 move back and forth in the main scanning direction; piezoelectric elements of the paste discharge head 65 are driven so that the paste is discharged onto the paper S based on the paste discharge data; and a drive motor 66*a* is controlled so that the paper S is transported by a predetermined amount in the sub scanning direction at every pass. Through this, the paste is applied to an adhesion surface of paper S based on a paste formation pattern having been set in accordance with a paper type group to which the paper S belongs. That is to say, because the paste is applied to either an area on the reverse side of an area on which an image is not printed or an area on the reverse side of an area on which the image is printed in accordance with the classification based on the paper type, the paste can be more appropriately applied to the paper S on which an image is printed in accordance with the state of image printing. After the paste application processing is performed in the manner described above, it is judged whether or not all the sheets of paper S have been processed (step S290). If not all of the sheets of paper S have been processed yet, the routine goes back to step S100 to repeat the processings; if all the sheets of paper S have been processed, the routine is ended.

Here, correspondence between constituent elements of the embodiment and constituent elements of the invention will be clarified. The paste application controller 52 of the paste application apparatus 50 that executes the processings in steps S110 through S260 of the paste application processing routine shown in FIG. 4 according to the embodiment corresponds to the "dot pattern setting unit" of the invention, meanwhile the paste application controller 52 that executes the processings in steps S270 and S280 of the paste application processing routine shown in FIG. 4 corresponds to the "control unit". Note that an example of a control method of the adhesive application apparatus of the invention is clarified as well through describing operations of the paste application controller 52 in the embodiment.

According to the paste application apparatus 50 of the embodiment, which has been described in detail thus far, a dot pattern is set such that an amount of paste for an area on the reverse side of an area on which an image is printed and an amount of paste for an area on the reverse side of an area on which the image is not printed differ from each other, and the paste discharge head 65 is so controlled that the set dot pattern is formed on the adhesion surface of paper S. Through this, since the amount of paste applied to paper S can be changed between an area on which an image is printed and an area on which the image is not printed, it is possible to apply the paste to paper S more appropriately in accordance with the state of image formation.

In addition, because a paste formation pattern is set in accordance with a paper type of paper S based on the group classification of paper type which is predetermined through experiment or the like, it is possible to suppress the papers S from deformation by exerting the tension force accompanying the hardening of paste on a deformed portion in a crinkled state caused by penetration of ink, suppress the deformation of paper S from being accelerated due to further penetration of paste into the deformed portion in a crinkled state caused by penetration of ink, and so on. Furthermore, it is judged based on the ink discharge amount It whether each divided area is an area on which an image is printed or not. Therefore, it is possible to set a paste formation pattern by a simple processing.

Note that the invention is not limited to the above-described embodiment in any way, and it is needless to say that the invention can be implemented with various aspects without departing from the technical scope of the invention.

Figure 7:
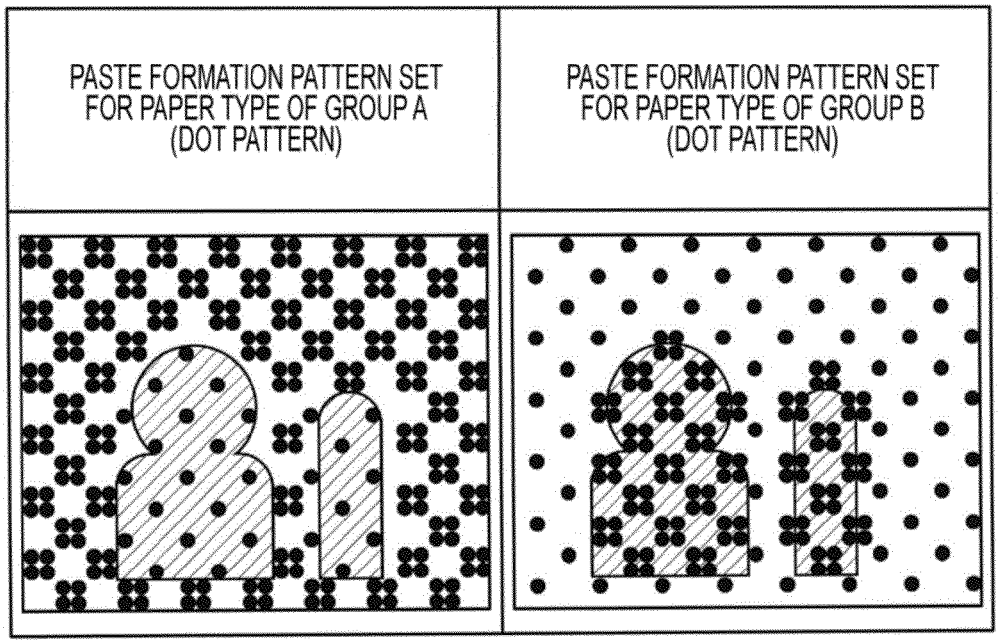
FIG. 7 is a descriptive diagram illustrating an example of a variation on paste formation patterns.

In the aforementioned embodiment, a paste application area to which the paste is applied and a non-paste application area to which the paste is not applied are set based on the ink discharge amount It, and then a paste formation pattern is set such that a constant number of paste dots (4 dots) are discharged to each paste application area. However, the invention is not limited thereto; that is, a paste formation pattern may be set such that the paste discharge amount has a tendency to increase with the increase of the ink discharge amount It, or a paste formation pattern may be set such that the paste discharge amount has a tendency to decrease with the increase of the ink discharge amount It. FIG. 7 illustrates a variation on paste formation patterns in such case. As shown in the drawing, the paste discharge amount of each paste application area changes in two levels (4 dots and 1 dot) in accordance with the ink discharge amount It. It is to be noted that the paste discharge amount of each paste application area may change in more than two levels.

In the above embodiment, although an area is judged whether or not to be an area on which an image is printed based on the comparison between the ink discharge amount It and the predetermined threshold value Iref, the invention is not limited thereto. That is, by obtaining data with a flag or the like that indicates an area for image printing, each area may be judged whether or not to be an area on which an image is printed in accordance with presence/absence of the flag.

In the aforementioned embodiment, although the same threshold value Iref is used in processing both the group A paper type and the group B paper type, the invention is not limited thereto and different threshold values may be used.

In the aforementioned embodiment, although a paste is applied after an image is formed, the invention is not limited thereto and the paste may be applied before the image is formed. In this case, print data may be obtained before actual image formation and the same processings as those of this embodiment may be executed.

In the aforementioned embodiment, although processing is switched in accordance with the groups of paper type, the invention is not limited thereto and processing may not be switched. In this case, for example, in an apparatus that applies a paste to paper S whose paper type belongs to the group A, steps S130 and S200 through S250 of the paste application processing routine shown in FIG. 4 may be omitted. Meanwhile, in an apparatus that applied a paste to paper S whose paper type belongs to the group B, steps S130 through S190 of the paste application processing routine shown in FIG. 4 may be omitted.

In the aforementioned embodiment, although the paste discharge amount is changed according to a paste formation pattern represented by presence/absence of dot formation, the invention is not limited thereto. That is, it is advisable that the paste application amount is changed through adjusting the discharge amount by changing the size of a dot itself just like the adjustment of ink discharge amount carried out in an ink jet printer.

In the aforementioned embodiment, although the adhesion surface of an odd-numbered sheet of paper S and the adhesion surface of an even-numbered sheet of paper S are pasted to each other, the invention is not limited thereto. For example, it is advisable that an odd-numbered sheet of paper S is mountain-folded in half so as to paste the adhesion surfaces of the mountain-folded paper S to each other and an even-numbered sheet of paper S is mountain-folded in half so as to paste the adhesion surfaces of the mountain-folded paper S to each other. Alternatively, it is advisable that an odd-numbered sheet of paper S and an even-numbered sheet of paper S are both valley-folded in half, thereafter an adhesion surface (half-surface) of the odd-numbered sheet of paper S and an adhesion surface (half-surface) of the even-numbered sheet of paper S are sequentially pasted to each other.

In the aforementioned embodiment, although the paste application apparatus 50 includes the reversal mechanism 54, the pasting mechanism 56 and the like in addition to the paste application mechanism 60, the invention is not limited thereto. That is, it is essential for the paste application apparatus 50 to include the paste application mechanism 60; however, the paste application apparatus 50 may not include either one of the reversal mechanism 54 and the pasting mechanism 56, or may not include any of the reversal mechanism 54 and the pasting mechanism 56. Although the paste application apparatus 50 is included in the book-binding system 10 and applies a paste to paper S for book-binding, the invention is not limited thereto and the paste application apparatus 50 may be separated and may apply the paste independently to the paper S.

In the aforementioned embodiment, although a liquid-form paste is used, the invention is not limited thereto and an adhesive that is capable of being discharged from a discharge head, such as a gel-form adhesive, may be used.

What is claimed is:

1. An adhesive application apparatus that discharges an adhesive from a discharge head so as to apply the adhesive in dot-pattern form to a reverse side of a sheet of paper on which an image is formed using a colorant, the apparatus comprising:

a dot pattern setting unit configured to set a dot pattern such that a first amount of the adhesive discharged to an first area on the reverse side of an image area on which the image is formed and a second amount of the adhesive discharged to a second area on the reverse side of a blank area on which the image is not formed are different from each other, wherein the dot pattern is based at least on reversal data obtained by reversing print data for the image; and a control unit configured to control the discharge head so that the dot pattern having been set by the dot pattern setting unit is formed on the reverse side of the paper.

2. The adhesive application apparatus according to claim 1, wherein the dot pattern setting unit is configured to set the dot pattern such that the adhesive is applied only to the first area on the reverse side of the image area on which the image is formed in a first case of using a predetermined type of paper, and sets a dot pattern such that the adhesive is applied only to the second area on the reverse side of the blank area on which the image is not formed in a second case of using a different type of paper from the predetermined type of paper.

3. The adhesive application apparatus according to claim 1, wherein the dot pattern setting unit is configured to:

define the image area on which the image is formed as having an amount of consumption of the colorant equal to or greater than a predetermined value, define the blank area on which the image is not formed as having the amount of consumption of the colorant less than the predetermine value, and change the first and second amounts of the adhesive discharged in accordance with the amount of consumption of the colorant so as to set the dot pattern.

4. The adhesive application apparatus according to claim 3, wherein the dot pattern setting unit is configured to set the dot pattern such that the first and second amounts of adhesive discharged become larger as the amount of the colorant consumed becomes larger.

5. The adhesive application apparatus according to claim 3, wherein the dot pattern setting unit is configured to set the dot pattern such that the first and second amounts of adhesive discharged become smaller as the amount of the colorant consumed becomes larger.

6. The adhesive application apparatus according to claim 1, wherein the dot pattern setting unit is configured to set the dot pattern such that the adhesive is applied only to the first area on the reverse side of the image area on which the image is formed in a case of using a predetermined type of paper.

7. The adhesive application apparatus according to claim 1, wherein the dot pattern setting unit is configured to set the dot pattern such that the adhesive is applied only to the second area on the reverse side of the blank area on which the image is not formed in a case of using a predetermined type of paper.

* * * * *